US010619396B2

(12) United States Patent
Kapuskar et al.

(10) Patent No.: US 10,619,396 B2
(45) Date of Patent: Apr. 14, 2020

(54) ACTIVE PIVOTING WINDOW REGULATOR SYSTEM

(71) Applicant: Faraday & Future Inc., Gardena, CA (US)

(72) Inventors: Daniel P. Kapuskar, Fountain Valley, CA (US); Cian John Francis Brogan, Franklin, MI (US)

(73) Assignee: FARADAY&FUTURE INC., Gardena, CA (US)

( * ) Notice: Subject to any disclaimer, the term of this patent is extended or adjusted under 35 U.S.C. 154(b) by 0 days.

(21) Appl. No.: 15/267,758

(22) Filed: Sep. 16, 2016

(65) Prior Publication Data

US 2017/0081898 A1 Mar. 23, 2017

Related U.S. Application Data

(60) Provisional application No. 62/219,890, filed on Sep. 17, 2015.

(51) Int. Cl.
*E05F 11/52* (2006.01)
*E05F 15/697* (2015.01)
*E05F 15/695* (2015.01)

(52) U.S. Cl.
CPC ..... *E05F 15/697* (2015.01); *E05F 11/525* (2013.01); *E05F 15/695* (2015.01); *E05Y 2900/55* (2013.01)

(58) Field of Classification Search
CPC ..... E05F 15/697; E05F 15/525; E05F 15/689; E05F 11/40; E05F 11/405; E05F 11/423; E05F 11/426; E05Y 2900/55
USPC ..... 49/227, 349, 350, 362, 352, 356
See application file for complete search history.

(56) References Cited

U.S. PATENT DOCUMENTS 4,089,134 A 5/1978 Koike
4,353,185 A * 10/1982 Saigne ..... E05F 11/405 49/349
4,970,827 A * 11/1990 Djordjevic ..... E05F 11/488 49/349
4,991,348 A * 2/1991 Yamamura ..... E05F 11/423 49/349
5,012,613 A * 5/1991 Sekine ..... B60J 1/17 49/349
5,309,677 A * 5/1994 Kunert ..... E05F 11/405 49/349
6,425,208 B1 * 7/2002 Klueger ..... E05F 11/382 49/348
7,021,001 B1 * 4/2006 Schooler ..... E05F 15/41 318/282
2001/0017472 A1 * 8/2001 Nishikawa ..... B60J 5/0416 292/262

(Continued)

*Primary Examiner* — Chi Q Nguyen
(74) *Attorney, Agent, or Firm* — Veros Legal Solutions, LLP

(57) ABSTRACT

A vehicle including a window regulator system is disclosed. The vehicle may include a vehicle door with an outer panel and an inner panel, a window regulator rail positioned between the outer panel and the inner panel, a glass pane which moves along the window regulator rail between the base of the window regulator rail and the top of the window regulator rail, and a rod attached to the window regulator rail. A motor may be configured to move the rod, and the movement of the rod may vary the position of the window regulator rail.

18 Claims, 4 Drawing Sheets

(56) References Cited

U.S. PATENT DOCUMENTS

| | | | | |
|---|---|---|---|---|
| 2001/0017476 | A1* | 8/2001 | Nishikawa | B60J 5/0416 296/146.6 |
| 2002/0047289 | A1* | 4/2002 | Furuyama | B60J 5/0416 296/146.7 |
| 2008/0276538 | A1* | 11/2008 | Costigan | E05F 11/488 49/375 |
| 2013/0123056 | A1* | 5/2013 | Ishida | F16H 1/28 475/149 |

* cited by examiner

ACTIVE PIVOTING WINDOW REGULATOR SYSTEM

CROSS-REFERENCE TO RELATED APPLICATIONS

This application claims the benefit of U.S. Provisional Application No. 62/219,890, filed on Sep. 17, 2015. The subject matter of the aforementioned application is incorporated herein by reference.

TECHNICAL FIELD

The present disclosure is directed to an active pivoting window regulator system, and particularly an active pivoting window regulator system for use in a vehicle.

BACKGROUND

Window regulator systems are used to allow a window pane to be raised and lowered. Often used in vehicles, window regulator systems may be positioned behind door panels, hidden from the eyes of consumers. Conventional, static, window regulator systems consist of a window regulator rail that is fixed between the inner and outer panels of a vehicle car door. The glass pane of the window is attached to the rail by a bracket, and slides up and down the rail, raising and lowering the window. A motor or, in some vehicles, a mechanical crank, moves the bracket up and down, controlling the position of the window.

In conventional window regulator systems, the position of the rail is fixed. As a result, the rail position must be meticulously adjusted during manufacture and design, in order to ensure the glass pane can be fully lowered, without meeting an obstruction. As a result, small access holes are generally positioned in the door paneling to allow future adjustments if necessary. These may be ascetically displeasing.

Further, because the regulator rail has a curvature matching that of the glass pane (to support the glass pane as it is raised and lowered), the positioning of other vehicle components (such as wiring etc., that are generally positioned between the door panels) and the curvature and contours of the car door must be determined with the window regulator system in mind. This limits the design options available to car manufacturers.

The disclosed active pivoting window regulator system is directed to addressing one or more of the problems discussed above and/or other problems of the prior art.

SUMMARY

In one aspect, the present disclosure is directed to a window regulator system. The window regulator system may include a window regulator rail extending from a base to a top, a glass pane movably connected to the window regulator rail (such that the glass pane may be able to move along the window regulator rail between the base and the top), a rod connected to the window regulator rail, and a motor configured to move the rod. The motor may be configured to move the rod, which may cause the position of the base of the window regulator rail to change.

In another aspect, the present disclosure is directed to a vehicle including a window regulator system. The vehicle may include a vehicle door, which may have an outer panel and an inner panel. Positioned between the inner panel and the outer panel, there may be a window regulator rail, which may extend from a base to a top. A glass pane may be movably connected to the window regulator rail (such that the glass pane may be able to move along the window regulator rail between the base and the top). A rod may be connected to the window regulator rail, and a motor may be configured to move the rod. The movement of the rod may cause the position of the base of the window regulator rail to change.

In yet another aspect, the present disclosure is directed to a method of regulating a window position. The method may include causing a glass pane to move a predetermined distance along a window regulator rail between a base of the window regulator rail and a top of the window regulator rail, causing a motor to move a rod connected to the window regulator rail, thereby moving the base of the window regulator rail, and causing the glass pane to move an additional distance along the window regulator rail after moving the rod.

DETAILED DESCRIPTION

Figure 1:
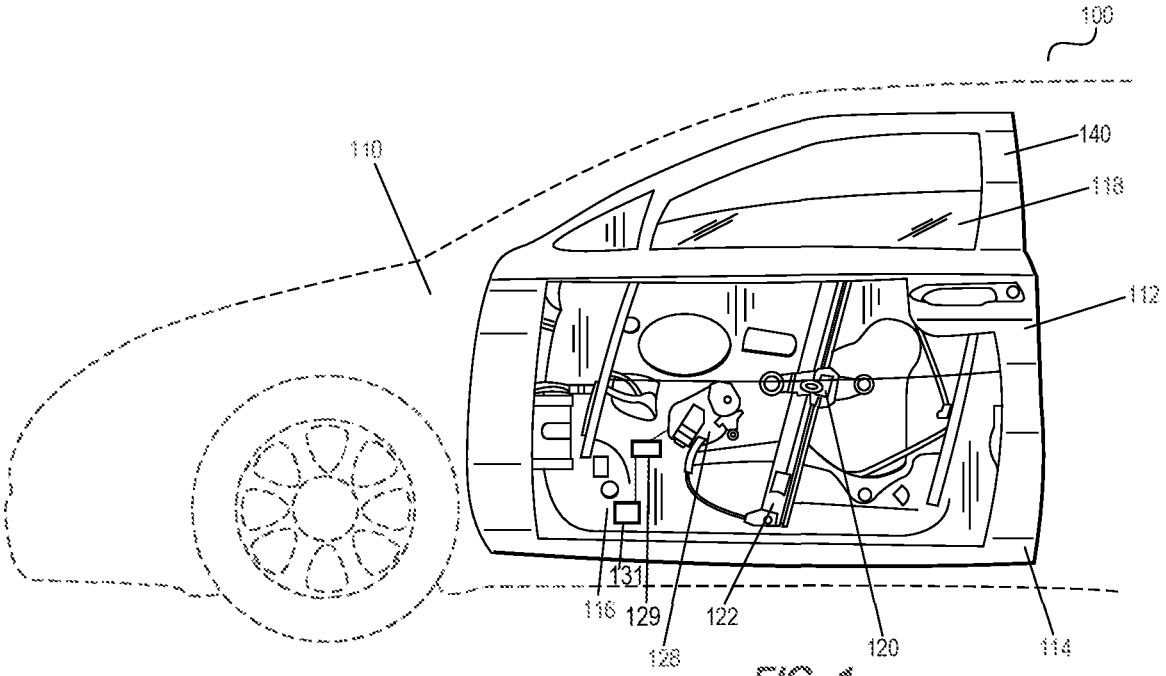
FIG. 1 is a diagrammatic illustration of an exemplary window regulator system.
Figure 2:
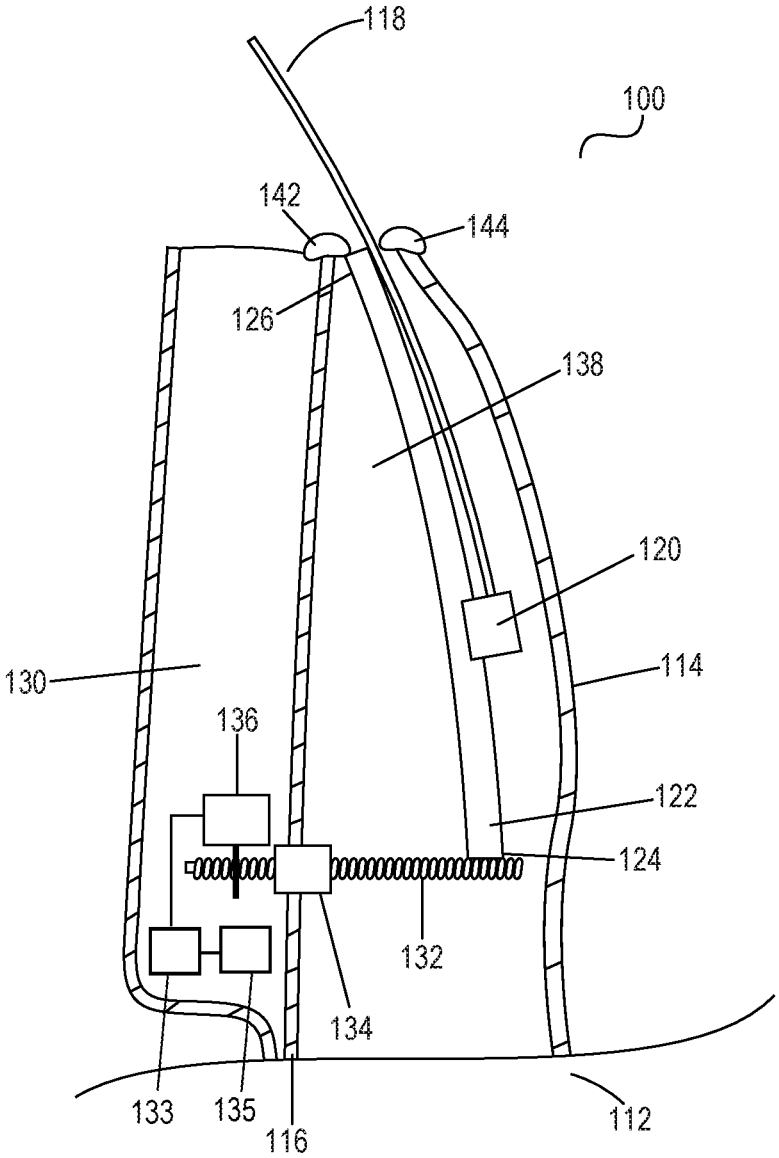
FIG. 2 is a diagrammatic illustration of a cross section of an exemplary window regulator system.

FIGS. 1-3 illustrate exemplary active pivoting window regulator systems. Such control systems may be implemented in a vehicle of any type. For example, the vehicle may be a car, truck, semi-truck, motorcycle, plane, train, moped, scooter, or other means of transportation. Furthermore, the vehicle may use any type of powertrains. For example, the vehicle may be an electric vehicle, a fuel cell vehicle, a hybrid vehicle or a conventional internal combustion engine vehicle.

FIG. 1 is a diagrammatic illustration of an exemplary window regulator system 100. As depicted in FIG. 1, window regulator system 100 may be employed in vehicle 110. Vehicle 110 may include vehicle door 112. Vehicle door 112 may include outer panel 114, inner panel 116, and glass pane 118.

As depicted in FIG. 1, outer panel 114 is cut away in order to show additional components of window regulator system 100. Bracket 120 may movably connect glass pane 118 to window regulator rail 122. Window regulator rail 122 may extend from base 124 to top 126. Glass pane 118 may move along window regulator rail 122 between base 124 and top 126. Motor 128 may be configured to move bracket 120, thus controlling the movement of glass pane 118 along window regulator rail 122. In some embodiments, window regulator rail 122 may actively pivot when glass pane 118 is lowered or raised to a certain position. For example, base 124 of window regulator rail 122 may move in a direction towards inner panel 116. Window regulator system 100 may include additional components, including those shown in FIG. 2, to enable window regulator rail 122 to actively pivot.

FIG. 2 is a diagrammatic illustration of a cross section of an exemplary window regulator system 100. In addition to the components visible in FIG. 1, which are designated by the same reference numerals, FIG. 2 depicts inner compartment 130 of vehicle door 112, which may be disposed adjacent to inner panel 116, on the interior portion of the vehicle (that is, closest to the passengers). FIG. 2 further depicts rod 132, which may be connected to window regulator rail 122, and supported by guide 134, which is connected, in this example, to inner panel 116. Motor 136 may be configured to move rod 132.

Outer panel 114 and inner panel 116 may define a space 138 in which mechanical and electrical components of vehicle 110, including components of window regulator system 100, may be disposed. Space 138 may be a watertight compartment or may be a non-watertight compartment. When lowered, glass pane may be disposed between outer panel 114 and inner panel 116 in space 138. Outer panel 114 may also define a frame or partial frame 140 in which glass pane 118 may be positioned when glass pane 118 is fully raised. Seals 142 and 144 are disposed between space 138 and frame 140. Seals 142 and 144 may help prevent moisture and other debris from entering space 138. Seals 142 and 144 may also support glass pane 118 as it is raised and lowered. It is contemplated that seals 142 and 144 may be of any dimensions, and may be internal or external to space 138.

When raised, glass pane 118 may be surrounded by frame 140 on all sides, or may be only partially surrounded. It is also contemplated that frame 140 may be omitted entirely, consistent with certain embodiments of vehicle 110.

Top 126 of window regulator rail 122 may be positioned within space 138 adjacent to seals 142 and 144. Base 124 may be positioned within space 138. Window regulator rail 122 may be made of any suitable material, for example, aluminum, steel, or hard plastic. The distance between base 124 and top 126 may be dictated by the dimensions of glass pane 118. The distance between base 124 and top 126 may be at least equal to the height of glass pane 118. Additionally, it is contemplated that multiple regulator rails may be used to support glass pane 118.

Glass pane 118 may be composed on any suitable material (such as regular glass, Plexiglas, thermochromic glass, safety glass, etc.). Glass pane 118 may be movably connected to window regulator rail 122 by bracket 120. The choice of materials and dimensions for glass pane 118 may be dictated by aesthetic or manufacturing concerns.

Bracket 120 may connect glass pane 118 to window regulator rail 122. Bracket 120 may slide along window regulator rail 122. For example, window regulator rail 122 may include a tongue corresponding to a grove in bracket 120 that allows bracket 120 to slide along the grove. Bracket 120 may be pulled up and down window regulator rail 122 by pulleys, belts, or other mechanisms known in the art.

Bracket 120 may be electrically controlled by motor 128. Motor 128 may cause bracket 120 to move up and down window regulator rail 122, in turn causing glass pane 118 to be raised and lowered. Motor 128 may be electrically connected to a switch or other interface (not shown) accessible to vehicle users. It is contemplated that window regulator system 100 may alternatively use a manual crank instead of motor 128.

Rod 132 may be connected to window regulator rail 122, and may be controlled by motor 136. Though depicted as a threaded rod, rod 132 may also be, for example, an unthreaded rod or a belt. Rod 132 may be rigid or non-rigid. Shown here connected to base 124, Rod 132 can be connected to window regulator 122 at any point between base 124 and top 126. Guide 134 supports rod 132 and guides the movement of rod 132. Though in FIG. 2, guide 134 is fixed to inner panel 116, guide 134 may alternatively be connected to outer panel 114, may be a hanging support or a platform within space 138 or inner compartment 130. Alternatively, guide 134 could be omitted, and inner panel 116 may include a hole that rod 132 passes through.

The movement of rod 132 may be controlled by motor 136. Motor 136 may be an electrical motor or a gearbox. Though motor 136 is depicted within inner compartment 130, it could also be positioned in space 138. Similarly, motor 128, which moves bracket 120 and controls the position of glass pane 118, may be disposed in inner compartment 130 or space 138. Motor 128 and/or motor 136 may also be positioned elsewhere in vehicle 110. When rod 132 is moved, rod 132 may push or pull window regulator rail in the direction rod 132 is moved. This may cause window regulator rail 122 to pivot (in this example around top 126, which is a fixed point), which in turn alters the path of glass pane 118 as it moves up or down window regulator rail 122.

FIGS. 3A to 3D depict the operation of exemplary window regulator system 100.

Figure 3A:
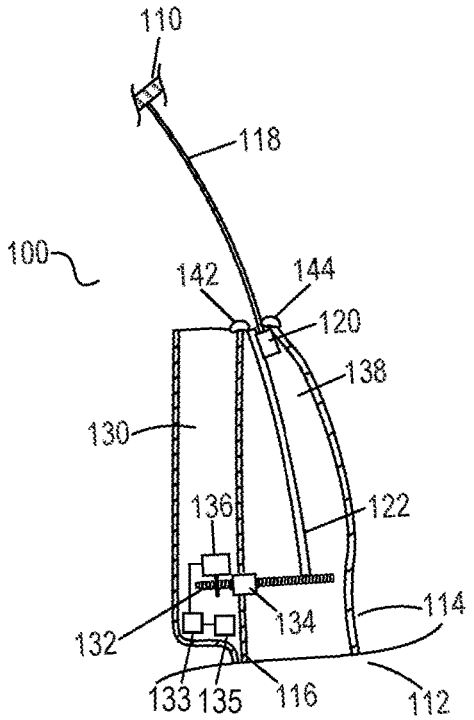
FIGS. 3A-3D are diagrammatic illustrations depicting the operation of an exemplary window regulator system.

FIG. 3A depicts glass pane 118 in a fully raised position. Bracket 120 is depicted adjacent to seals 142 and 144, at top 126 of window regulator rail 122 and rod 132 is shown in a first position.

Figure 3B:
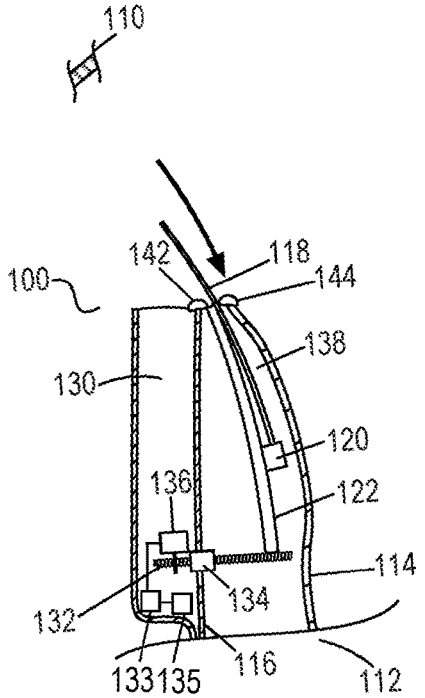

FIG. 3B depicts glass pane 118 beginning to lower. Motor 128 may lower bracket 120, which in turn may lower glass pane 118 until glass pane 118 approaches an obstruction (for example seals 142 and/or 144 or an obstruction created by outer panel 114).

Bracket 120 or glass pane 118 may include a sensor operable to send a signal to a controller 129 that is coupled to motor 128. This signal alerts controller 129 that glass pane 118 is approaching an obstruction, and causes controller 129 to generate a signal to motor 128, causing motor 128 to stop lowering glass pane 118. Such a sensor may communicate with controller 129 wirelessly via infrared, Bluetooth®, wireless network, radio, or other near-field communication system or through a wired connection. Controller 129 may include any appropriate type of general-purpose or special-purpose microprocessor, digital signal processor, or microcontroller, memory, storage, and an input/output interface, and may be configured to receive signals from sensors and generate control signals instructing motor 128 to start and stop. Controller 129 may be used solely for window regulator system 100, or may perform additional functions.

Alternatively, window regulator system 100 may include a step counter or timing mechanism 131 that tracks the steps of motor 128, or the speed of motor 128 (which may be expected to slow down when window glass pane 118 collides with an obstruction), to monitor the position of bracket 120 or glass pane 118. The step counter 131 may be wirelessly (via infrared, Bluetooth®, wireless network, radio, or other near-field communication system) or wiredly coupled to a controller (such as controller 129 described above), which may be configured to recognize the number of steps motor 128 has taken or the amount of time motor 128 has been moving bracket 120, and send a command signal to motor 128 to stop lowering bracket 120 (and glass pane 118) after a pre-determined number of steps or a predetermined amount of time.

Figure 3C:
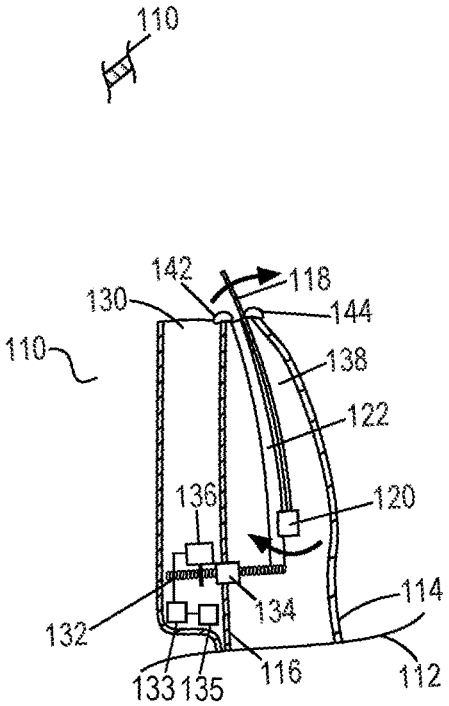

As shown in FIG. 3C, after motor 128 stops, motor 136 begins to move rod 132 Like motor 128, motor 136 may be coupled to a controller (either controller 129 coupled to motor 128 or a separate controller 133 with similar properties) that receives a signal (wired or wirelessly) and generates a command to motor 136 to begin moving rod 132. The signal may come from a sensor, may be triggered by the step counting or timing mechanism 131 that tracks the activity of motor 128, or may be triggered by motor 128 slowing or stopping. It is contemplated that motor 136 may be configured to move rod 132 automatically when motor 128 stops, or may begin moving rod 132 in response to a signal from a user (for example, by a second push to a switch or button or other interface that controls the position of glass pane 118).

Motor 136 may then move rod 132 a predetermined distance toward inner compartment 130, causing window regulator rail 122 to pivot about top 126. Alternatively, another fixed point along window regulator rail 122 may serve as the pivot point. The distance rod 132 moves may be dictated by the dimensions of the obstruction. Window regulator system 100 may include a step counter or timing mechanism 135 that tracks the number of steps taken by motor 136 or the amount of time that motor 136 has moved rod 132. The step counter 135 may be coupled to a controller, which may be controller 129 connected to motor 128 or second controller 133. The controller may be configured to recognize the number of steps motor 128 has taken (or the speed of the steps) or the amount of time motor 128 has been moving bracket 120, and send a command signal to motor 128 to stop lowering bracket 120 (and glass pane 118) after a pre-determined number of steps or a predetermined amount of time. Alternatively, a sensor disposed in inner compartment 130 or in space 138, for example on inner panel 116, rod 132, guide 134 or another vehicle component, may send a wired or wireless signal to controller 133 coupled to motor 136 which directs motor 136 to stop moving rod 132 when rod 132 has reached a predetermined location.

Though described separately, it is contemplated that the stages depicted in FIG. 3B and 3C may occur simultaneously, so that instead of fully stopping when glass pane 118 approaches the obstruction, motor 128 may continue moving bracket 120 as motor 136 moves rod 132.

Further, though in FIG. 3, motor 136 is positioned to pull rod 132 through guide 134 depicted here towards inner compartment 130, motor 136 may also be positioned on the opposite side of window regulator rail 122, so that it acts to push rod 132 towards inner compartment 130.

Figure 3D:
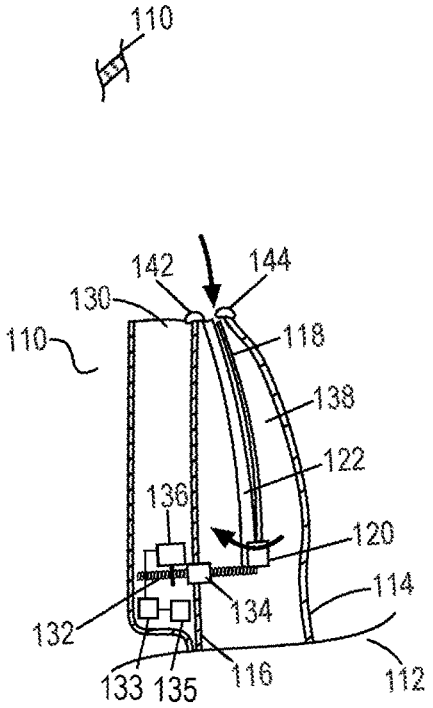

As depicted in FIG. 3D, when motor 136 has moved rod 132 the predetermined distance, motor 136 may stop moving rod 132. Motor 128 may then continue to move bracket 120, continuing to lower bracket 120 (and glass pane 118) until glass pane 118 is fully within space 138.

To raise glass pane 118 the operation may be reversed. For example, bracket 120 may be raised until glass pane 118 nears the obstruction. Motor 136 may then move rod 132 toward outer panel 114. When rod 132 has moved back to the first position, motor 136 may stop, and motor 128 may resume raising glass pane 118. Again, it is also contemplated that motor 128 might continue to raise bracket 120 while motor 136 moves rod 132 back to the original position.

A user may halt the process of raising or lowering glass pane 118 at any time, stopping glass pane 118 at a position that is neither fully raised nor fully lowered. When the glass pane 118 is again moved, window regulator system 100 may begin the process for raising or lowering glass pane 118 from that point. For example, assume glass pane 118 is raised to a halfway raised position and stopped. To fully raise glass pane 118, window regulator system 100 may continue the process of raising the window from the point at which the process stopped. Similarly, if glass pane 118 is to be lowered, window regulator system 100 may lower glass pane 118 from the halfway-raised position.

Figure 4:
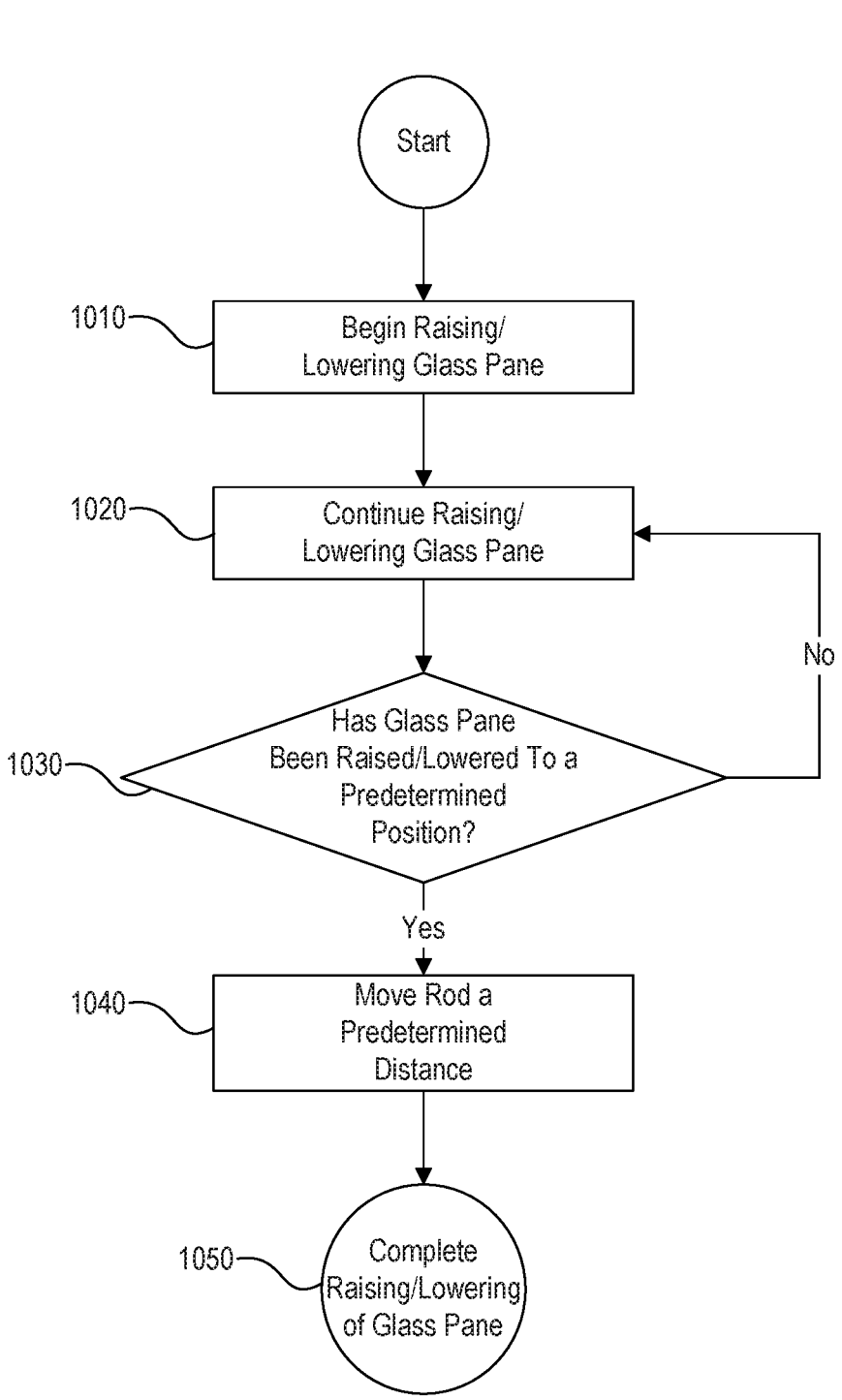
FIG. 4 is a flow chart illustrating an exemplary method employing an exemplary window regulator system.

FIG. 4 illustrates the steps of an exemplary method 1000 for completing the process of raising or lowering a window using window regulator system 100. After a user determines to raise or lower glass pane 118 of a window, in step 1010 window regulator system 100 may begin to raise or lower glass pane 118. Then, at steps 1020 and 1030, window regulator system 100 may continue to raise or lower glass pane 118 until it reaches a predetermined position. Window regulator system 100 may include step counter or timing mechanism 131 that counts the number of steps taken by motor 128 and sends a signal to controller 129, which generates a command signal to motor 128 instructing motor 128 to start or stop moving glass pane 118. Alternatively, a sensor may send a signal to controller 129 alerting it that glass pane 118 is approaching an obstruction, as described above. If glass pane 118 has not moved the predetermined distance, window regulator system 100 may continue to raise or lower glass pane 118, if it has, the method may advance to 1040, and rod 132 of window regulator system 100 is moved a predetermined distance to pivot window regulator rail 122, altering the path of glass pane 118. As discussed, Window regulator system 100 may include an additional step counter or timing mechanism 135 that counts the number of steps taken by motor 136 and sends a signal to controller 133, which generates a command signal to motor 136 instructing motor 136 to start or stop moving rod 132. Alternatively, a sensor may send a signal to controller 133 alerting it that rod 132 is approaching a particular point, as described above. When rod 132 has been moved, window regulator system 100 may continue raising or lowering glass pane 118 until it is fully raised or lowered.

The disclosed control system may be implemented both as an integrated part in vehicles and as a separately sold system. For instance, the user (or mechanic) may install a new window regulator system to an existing vehicle when replacing an existing system. Furthermore, particular components of the system (e.g., the glass pane, the motor, or the rod) may be replaced. Manufacturers may also use the disclosed exemplary window regulator system to adjust the position of the window regulator system by electronically moving the motor. This obviates the need for the aesthetically displeasing access holes required by many existing window regulator systems.

Though described with reference to vehicle components, and particularly with reference to vehicle windows, the disclosure is not limited to use in vehicles. For example, the disclosed systems may be applied to a pocket door. The regulator rail may be attached to the door at the door jam. When the door closes, the door slides along the regulator rail until reaching an obstruction, at which point the rail is pivoted to avoid the obstruction, allowing the door to fully close.

It will be apparent to those skilled in the art that various modifications and variations can be made to the vehicle control system. Other embodiments will be apparent to those skilled in the art from consideration of the specification and practice of the disclosed window regulator system. It is intended that the specification and examples be considered as exemplary only, with a true scope being indicated by the following claims and their equivalents.

The invention claimed is:

1. A window regulator system, comprising:

a window regulator rail extending from a base to a top;

a glass pane movably connected to the window regulator rail such that the glass pane is able to move in a path along the window regulator rail between the base and the top;

a rod connected to the window regulator rail;

a controller; and a motor coupled to the controller and configured to move the rod in response to a command from the controller, wherein the movement of the rod pivots the window regulator rail thus altering the path of the glass pane.

2. The system of claim 1, where the rod is connected to the base of the window regulator rail.

3. The system of claim 1, wherein the movement of the rod does not vary a position of the top of the window regulator rail.

4. The system of claim 1, wherein the motor comprises a gearbox.

5. The system of claim 1, wherein the rod is a threaded rod.

6. The system of claim 1, wherein the rod is a belt.

7. The system of claim 1, wherein the system is configured to measure a distance the glass pane has moved along the window regulator rail, wherein the motor moves the rod based, at least in part, on the glass pane reaching a pre-determined position.

8. A vehicle including a window regulator system, comprising:

a vehicle door including an outer panel and an inner panel;

a window regulator rail disposed between the outer panel and the inner panel, which extends from a base to a top;

a glass pane movably connected to the window regulator rail such that the glass pane is able to move in a path along the window regulator rail between the base and the top;

a rod connected to the window regulator rail;

a controller; and a motor coupled to a controller and configured to move the rod in response to a command from the controller, wherein movement of the rod pivots the window regulator rail thus altering the path of the glass pane.

9. The vehicle of claim 8, wherein the motor is disposed nearer to the inner panel than the outer panel.

10. The vehicle of claim 9, wherein the motor is disposed outside a space between the inner panel and the outer panel.

11. The vehicle of claim 8, further including an inner seal and an outer seal disposed proximate to the top of the window regulator rail.

12. The vehicle of claim 8, wherein the top of the window regulator rail does not move.

13. The vehicle of claim 8, wherein the motor comprises a gearbox.

14. The vehicle of claim 8, wherein the rod is a threaded rod.

15. The vehicle of claim 8, wherein the rod is a belt.

16. The vehicle of claim 8, wherein the system is configured to move the rod based, at least in part, on the glass pane reaching a pre-determined position.

17. The vehicle of claim 8, wherein the window regulator system regulates a window that is frameless on at least one side.

18. A method of regulating a window position, comprising:

moving a glass pane a predetermined distance in a path along a window regulator rail between a base of the window regulator rail and a top of the window regulator rail;

automatically pivoting the window regulator rail in response to detecting the glass pane stopped moving in the path along the window regulator rail, thereby altering the path of the glass pane; and moving the glass pane an additional distance along the window regulator rail after pivoting the window regulator rail.

* * * * *